US006654475B2

(12) United States Patent
Nakaso

(10) Patent No.: US 6,654,475 B2
(45) Date of Patent: Nov. 25, 2003

(54) ELECTRICITY-TO-SOUND TRANSDUCER

(75) Inventor: Jiro Nakaso, Sagamihara (JP)

(73) Assignee: Victor Company of Japan, Ltd., Yokohama (JP)

( * ) Notice: Subject to any disclaimer, the term of this patent is extended or adjusted under 35 U.S.C. 154(b) by 229 days.

(21) Appl. No.: 09/964,528

(22) Filed: Sep. 28, 2001

(65) Prior Publication Data

US 2002/0039430 A1 Apr. 4, 2002

(30) Foreign Application Priority Data

Sep. 29, 2000 (JP) ..... 2000-299072
Oct. 3, 2000 (JP) ..... 2000-303294

(51) Int. Cl.[7] ..... H04R 1/00

(52) U.S. Cl. ..... 381/396; 381/407; 381/423; 381/424; 381/431; 381/412

(58) Field of Search ..... 381/396, 407, 381/423, 424, 431, 412, 421, 404, 398, 430

(56) References Cited

U.S. PATENT DOCUMENTS 5,664,024 A * 9/1997 Furuta et al. ..... 381/412
6,341,167 B1 * 1/2002 Okuyama et al. ..... 381/407

FOREIGN PATENT DOCUMENTS

JP 11-075292 3/1999
JP 11-075293 3/1999
JP 11-168794 6/1999
JP 11-168795 6/1999
JP 2000-032586 1/2000
JP 2000-032588 1/2000

* cited by examiner

*Primary Examiner*—Curtis Kuntz
*Assistant Examiner*—Tuân D Nguyêñ
(74) *Attorney, Agent, or Firm*—Jacobson Holman PLLC

(57) ABSTRACT

An electricity-to-sound transducer has a diaphragm having an asymmetric shape which is flat when viewed from a direction of vibration, with major and minor axes, having continuous curvatures of concavity and convexity in a direction of sound irradiation, provided with a slot formed almost at a center of the diaphragm in a direction perpendicular to a longitudinal direction of the diaphragm. An edge portion is formed as surrounding an outer periphery of the diaphragm, an inner section of the edge portion being connected to the outer periphery, the edge portion sustaining the diaphragm so that it can vibrate. A voice coil bobbin has a winding portion around which a voice coil is wound split into two portions in the longitudinal direction of the diaphragm, the bobbin being attached to a rear surface of the diaphragm while the two portions are joined to each other, the joined portions forming a reinforcing beam that reaches a rear surface of a bottom of the slot of the diaphragm. The voice coil is applied flux by a magnetic circuit for vibration. The outer periphery of the edge portion and the magnetic circuit are sustained by a frame.

5 Claims, 23 Drawing Sheets

FRONT CROSS-SECTION

ELECTRICITY-TO-SOUND TRANSDUCER

BACKGROUND OF THE INVENTION

The present invention relates to an electricity-to-sound transducer such as a slender speaker having high sound quality.

With increased popularization of high-vision and wide-vision etc., TV sets with wide screens have widely been used. There is, however, increased demands in Japan for thin and not-so-wide TV sets and also audio component systems due to relatively poor Japanese housing conditions.

Speaker units for TV sets are for example one of the causes for TV sets that inevitably become wide. Because speaker units are mostly set on both sides of a cathode ray tube. Thus, most known speaker units have been not so wide such as rectangular and oval types. However, as cathode ray tubes become wide, there is a strong demand for slender speaker units as narrow as possible and for high sound quality that matches high picture quality in high-vision and wide-vision.

Known slender-type speakers, however, cannot meet such a demand due to distributed vibration that easily occurs in the long axis direction because of one-point driving at the center section of a slender diaphragm. This results in a peak dip in reproduced acoustic-pressure frequency characteristics in middle and high tone ranges, thus decreasing sound quality.

The applicant for this patent application has proposed, in Japanese Patent Application No. 10-192048, an electricity-to-sound transducer with flat frequency characteristics for high sound quality with less distributed vibration even though it is made as a slender structure.

This electricity-to-sound transducer is described with reference to FIGS. 5 to 8.

A reinforcing member 40 is inserted from above into each slot 38 formed at an almost center section of a diaphragm 31 in the longitudinal direction and almost perpendicular to this longitudinal direction. The diaphragm 31 is supported by the reinforcing member 40. Several materials can be used as the member 40 for supporting the diaphragm 31, such as metal, resin and wood. The member 40 is formed in a long rod with cuts 41 provided on the bottom surface at a constant interval. A voice coil 33 is passed through each cut 41 and wound around each of main vibrating portions 31*a* at the base section.

A magnetic field is generated around the voice coil 33 by magnets 35 to cause a drive current flowing the coil 33 for generating an electromagnetic force. The main vibrating portions 31*a* are vibrated by the electromagnetic force, and thus the diaphragm 31 is vibrated. During this vibration, however, distributed vibration is prevented from occurrence at the center section of the diaphragm 31 in the longitudinal direction because the slots 38 on the center section are supported by the reinforcing member 40.

Formed on the upper surface of each main vibrating portion 31*a* are convex semi-circular cylinder portions 39*a* and concave semi-circular cylinder portions 39*b* provided alternately in the longitudinal direction. This structure has a high mechanical strength (rigidity) against force to be applied in a direction perpendicular to the longitudinal direction. Without this structure, it could happen that a main vibrating portion 31*a* starts to vibrate larger or smaller than the neighboring one with no vibration in synchronism with each other at the border between the two vibrating portions.

Such large and small vibration components are, however, complimentarily prevented from occurrence by employing the structure explained above.

FIG. 9 illustrates vibration occurring on the diaphragm 31 of the electricity-to-sound transducer described above in a free-vibration mode. Observed around the slots 38 is distributed vibration restricted in the free-vibration mode. Also restricted is distributed vibration occurring around the center section of the diaphragm 31 in the longitudinal direction.

FIG. 10 illustrates a result of numerical analysis on the frequency response characteristics of vibration amplitude around the center section of the diaphragm 31. The solid line "A" indicates the result on the electricity-to-sound transducer disclosed in Japanese Patent Application No. 10-192048. The dot line "B" indicates the result on another known electricity-to-sound transducer. Observed in this figure is that the known transducer suffers from amplitude depression at frequencies of about 13.5 KHz or more whereas, for the transducer in the Patent Application above, the frequency characteristics is improved such that peaks are depressed at a high frequency range around 10 KHz while depression at frequencies of about 13. 5 KHz or more is not so badly and this continues to 15 KHz.

These electricity-to-sound transducers, however, have drawbacks as discussed below with reference to FIGS. 11 and 12.

The diaphragm 31 is protected from distributed vibration at its center section in the longitudinal direction by means of the reinforcing member 40 inserted in the slots 38 from above, as indicated by arrows in FIG. 11, in the direction perpendicular to the longitudinal direction.

Considerably deep slots must be formed as the slots 38 for depth H shown in FIG. 11 for stably sustaining the reinforcing member 40. Such a deep slot, however, causes a problem in that an upper edge 34*a* of a voice coil bobbin 34 touches a lower edge 38*a* of each slot 38 when the bobbin wound a voice coil 33 is inserted from the bottom of the diaphragm 31, so that the bobbin cannot be fit in the prescribed position.

On the other hand, a slot 38 formed as not so deep for resolving such a problem on the voice coil bobbin 34 cannot resolve the problem in that the diaphragm is fallen inwardly at the center section as discussed above.

SUMMARY OF THE INVENTION

A purpose of the present invention is to provide an electricity-to-sound transducer that has a new structure for a diaphragm and a voice coil bobbin attached to the diaphragm with less abnormal vibration which may otherwise occur in the longitudinal direction due to natural frequency of the diaphragm, for normal sound irradiation in response to a large input.

The present invention provides an electricity-to-sound transducer comprising: a diaphragm having an asymmetric shape which is flat when viewed from a direction of vibration, with major and minor axes, having continuous curvatures of concavity and convexity in a direction of sound irradiation, provided with a slot formed almost at a center of the diaphragm in a direction perpendicular to a longitudinal direction of the diaphragm; an edge portion formed as surrounding an outer periphery of the diaphragm, an inner section of the edge portion being connected to the outer periphery, the edge portion sustaining the diaphragm for vibration; a voice coil bobbin having a winding portion around which a voice coil is wound split into two portions in the longitudinal direction of the diaphragm, the bobbin being attached to a rear surface of the diaphragm while the two portions are joined to each other, the joined portions forming a reinforcing beam that reaches a rear surface of a bottom of the slot of the diaphragm; a magnetic circuit for applying flux to the voice coil for vibration; and a frame for sustaining the outer periphery of the edge portion.

Moreover, the present invention provides an electricity-to-sound transducer comprising: a diaphragm having an asymmetric shape which is flat when viewed from a direction of vibration, with major and minor axes, having continuous curvatures of concavity and convexity in a direction of sound irradiation, provided with a slot formed almost at a center of the diaphragm in a direction perpendicular to a longitudinal direction of the diaphragm, the slot having walls on a bottom of slot, on both ends of the slot in a direction of the major axis and on both ends of the slot in a direction of the minor axis, the slot protruding in a direction of a rear surface of the diaphragm to form a protrusion; an edge portion formed as surrounding an outer periphery of the diaphragm, an inner section of the edge portion being connected to the outer periphery, the edge portion sustaining the diaphragm for vibration; a voice coil bobbin attached to the rear surface of the diaphragm, an inner size of the bobbin almost at the center in the longitudinal direction being larger than an outer size of the protrusion in the direction of the minor axis, the protrusion being inserted into the bobbin, a gap between an inner wall of the bobbin and the protrusion being filled with an adhesive so that the protrusion and the bobbin are bonded to each other; a voice coil wound around the voice coil bobbin; a magnetic circuit for applying flux to the voice coil for vibration; and a frame for sustaining the outer periphery of the edge portion.

DETAILED DESCRIPTION OF PREFERRED EMBODIMENTS

Figure 1:
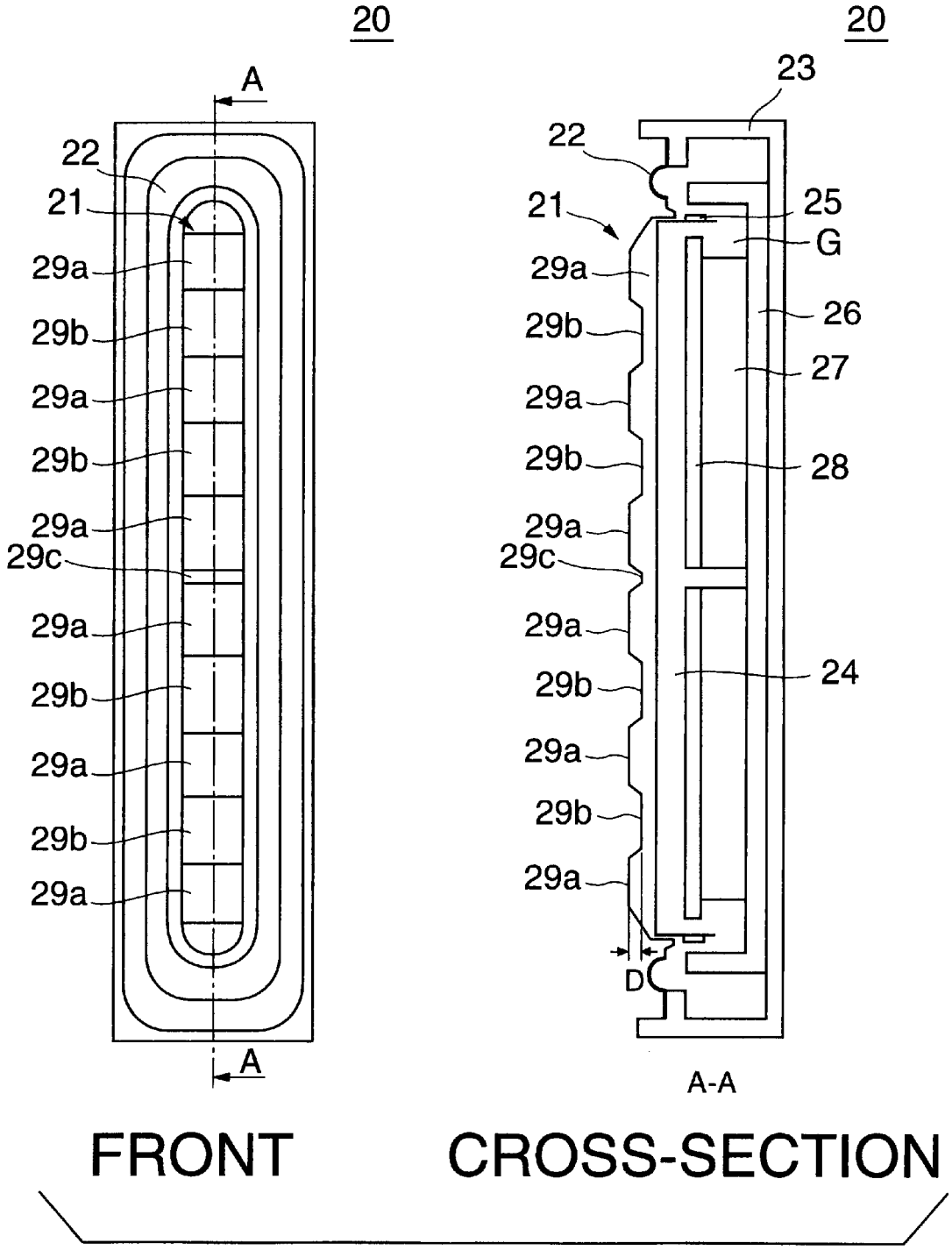
FIG. 1 shows a electricity-to-sound transducer, a basic configuration in the present invention.

FIG. 1 shows a front view (FRONT) and a cross-sectional view (CROSS-SECTION) taken on line A—A of a slender-type electricity-to-sound transducer 20, a basic configuration in the present invention.

A diaphragm 21 has an asymmetric shape which is flat when viewed from the direction of vibration, with major and minor axes, having continuous curvatures of concavity and convexity in the direction of sound irradiation. An edge 22 is joined to the diaphragm 21 at periphery and held by a frame 23.

Figure 2:
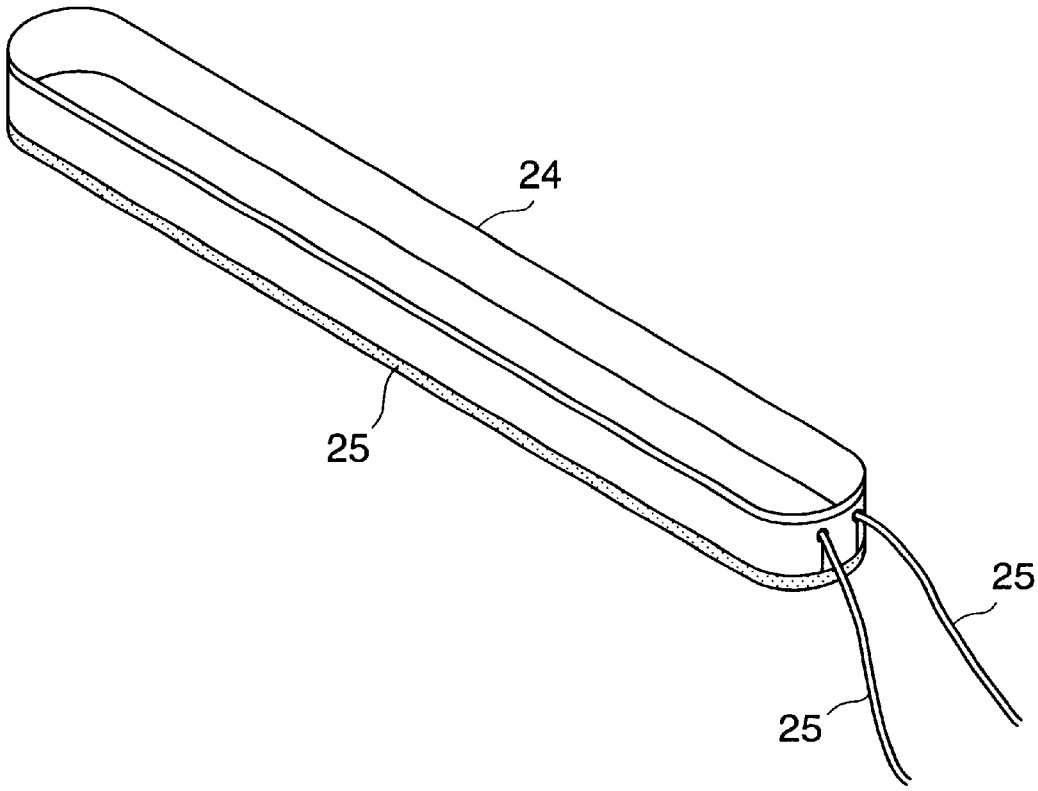
FIG. 2 shows a voice coil bobbin used for the electricity-to-sound transducer shown in FIG. 1.

A track-type voice-coil bobbin 24 shown in FIG. 2 is attached to the diaphragm 21 at the rear surface of the bobbin, for example, by an adhesive, with a voice coil 25 wound around the lower edges of the bobbin outer periphery. The voice-coil bobbin 24 is hanging in a magnetic gap G of a magnetic circuit which will be described later, for generating a driving power from voice signal currents and fluxes.

The frame 23 is like a box that is bending at the side-face sections toward the direction of the edge 22. The magnetic circuit described above is mounted on the inner bottom of the frame 23. An iron yoke 26, a magnet 27 and a pole piece 28 constitute the magnetic circuit, which are fixed at respective positions by a tool (not shown). In particular, the magnet 27 and the pole piece 28 are fixed at the positions that correspond to a main vibrating section of the diaphragm 21.

The diaphragm 21 is described in detail. It has an asymmetric shape which is flat when viewed from the direction of vibration, with major and minor axes, having continuous curvatures of concavity and convexity in the direction of sound irradiation, as mentioned above. Portions 29*a* are formed in convexity whereas portions 29*b* in concavity. The convex portions 29*a* and the concave portions 29*b* are provided alternately to form continuous curvatures. The concave portions 29*b* have almost the same depth D. The diaphragm 21 is made of a polyimide (PI) film that is heat-resistant against the voice coil 25 and excellent in mechanical properties. The diaphragm 21 is also provided with a concave slot 29*c* formed almost at the center section. The convex portions 29*a*, the concave portions 29*b* and the concave slot 29*c* are formed with a PI film as being integral with each other.

Figure 3:
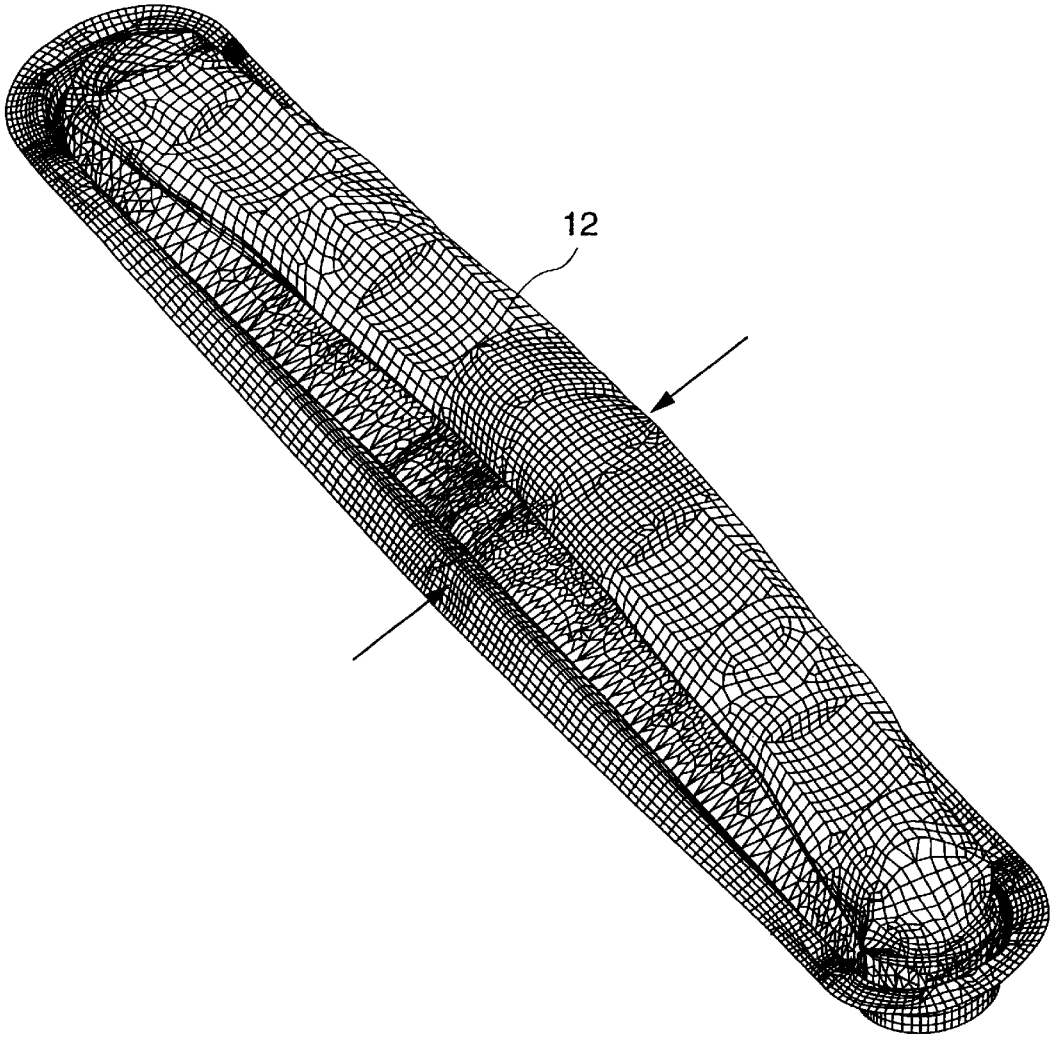
FIG. 3 illustrates that a diaphragm used for the electricity-to-sound transducer shown in FIG. 1 is fallen inwardly at the center section.

A diaphragm used for a speaker is preferably formed as thin as possible because the thicker the heavier it is, thus requiring a powerful magnetic circuit. The diaphragm 21 has, however, a problem in that it looses a mechanical strength when made as a thin diaphragm, which results in that it is fallen inwardly at the center section as illustrated in FIG. 3.

Figure 4:
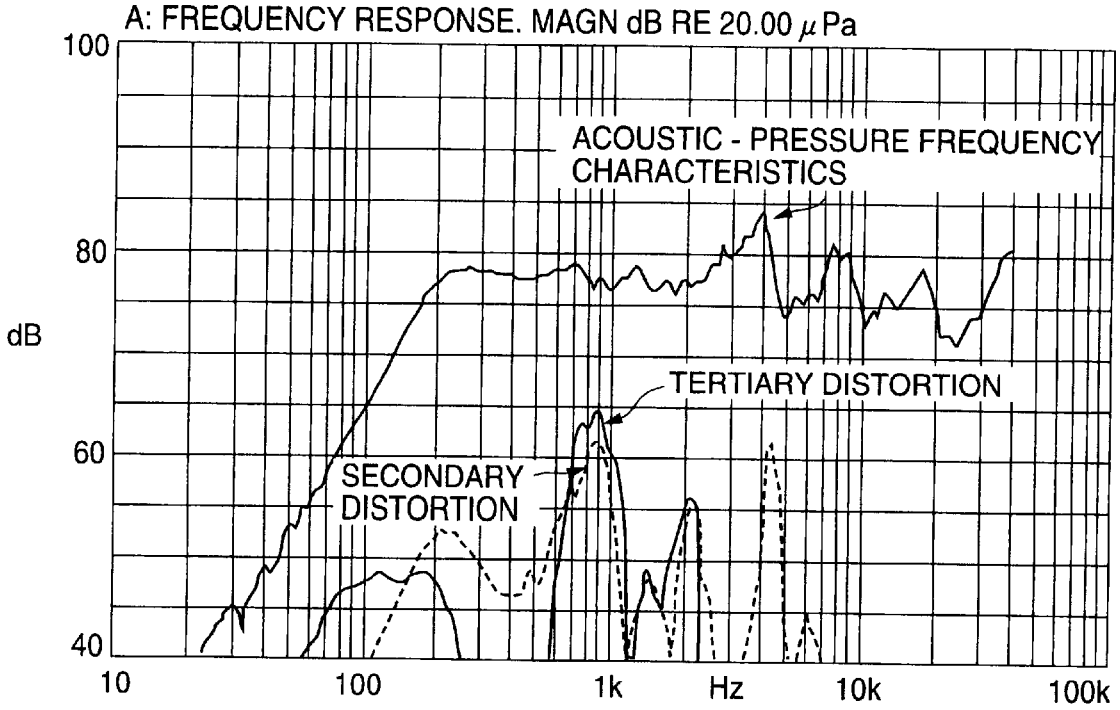
FIG. 4 is a graph indicating the frequency characteristics of the electricity-to-sound transducer shown in FIG. 1.
Figure 5:
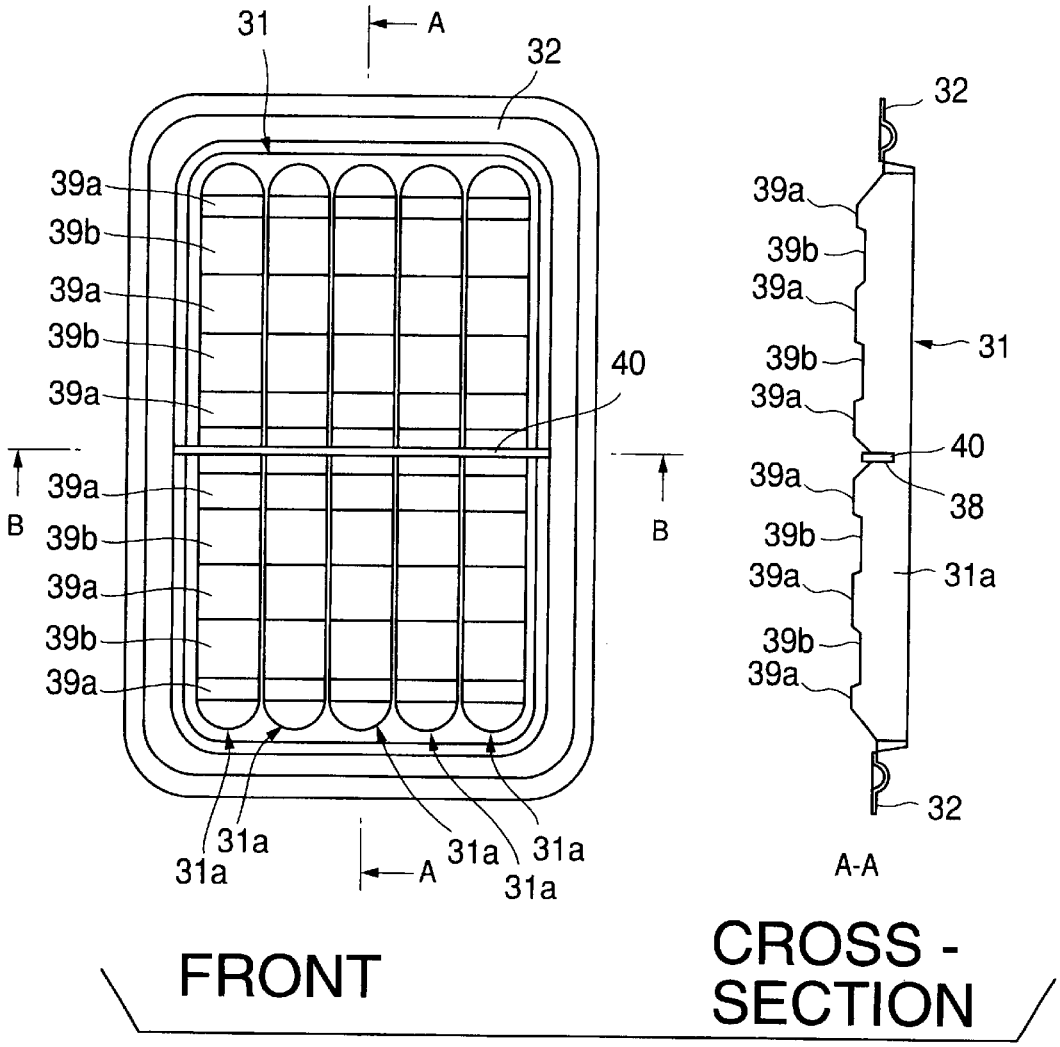
FIG.5 (RELATED ART)
FIG. 5 shows a diaphragm used for a known electricity-to-sound transducer.
Figure 6:
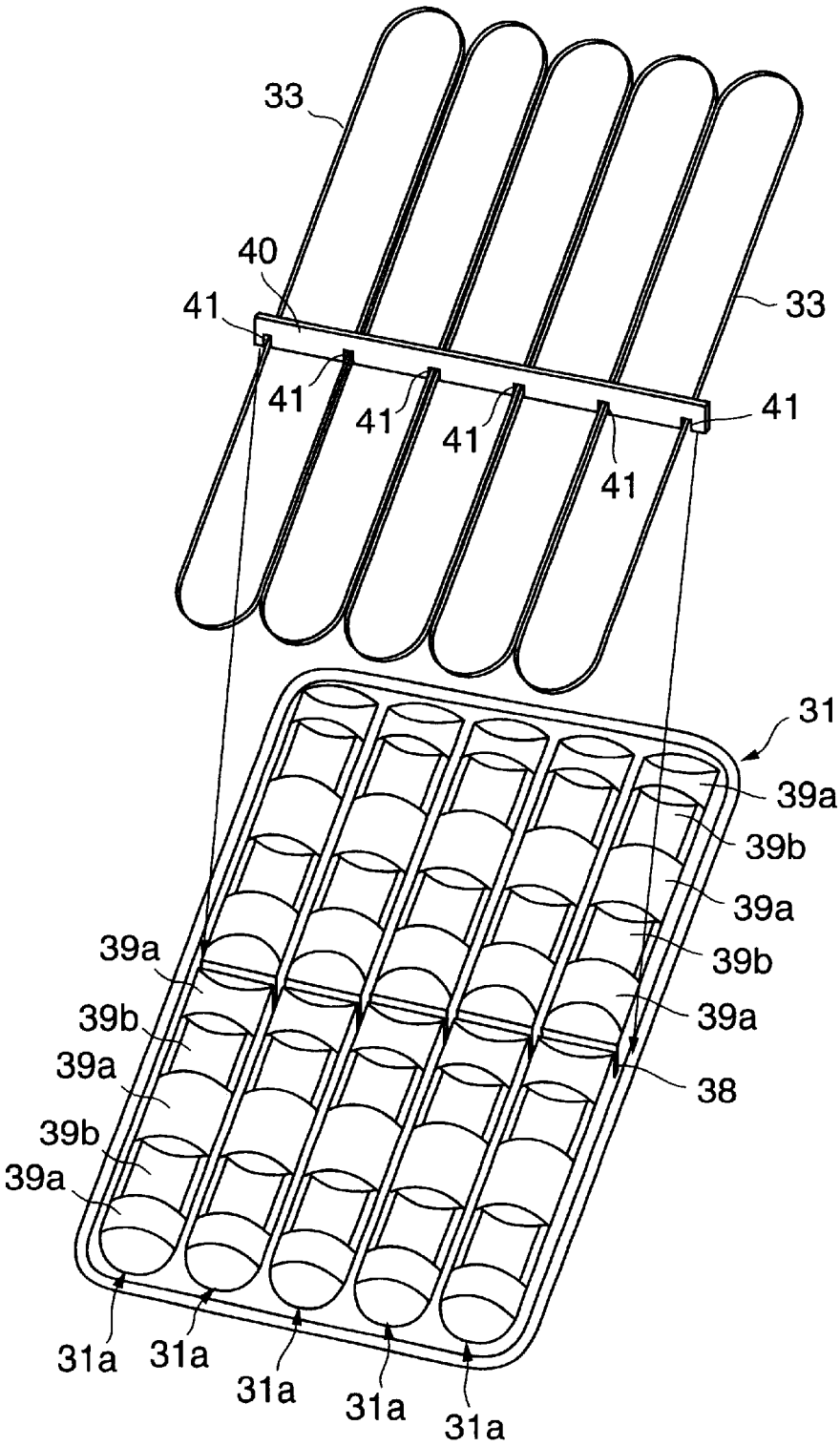
FIG.6 (RELATED ART)
FIG. 6 is an exploded perspective view of the diaphragm and other components used for the other known electricity-to-sound transducer.
Figure 7:
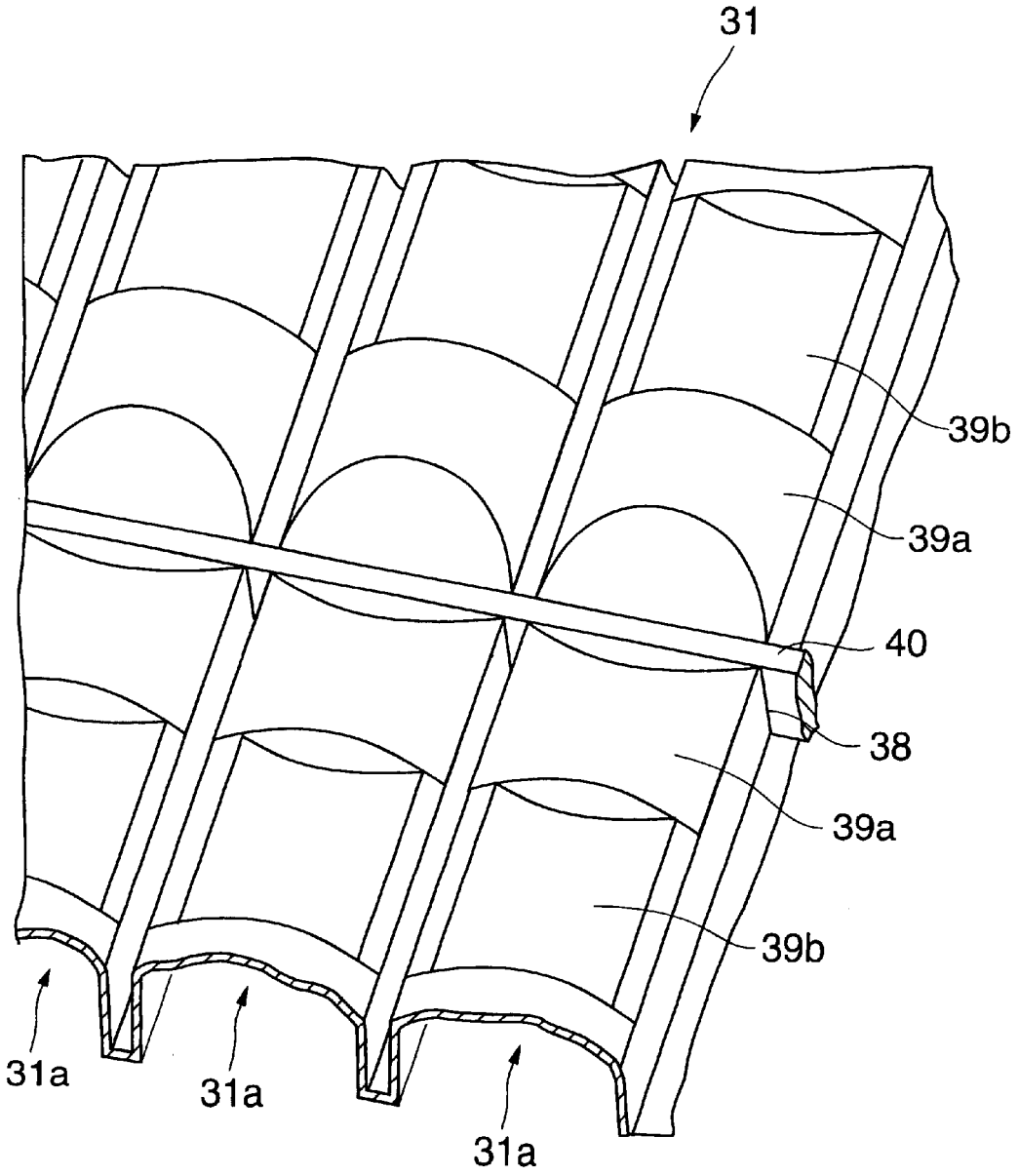
FIG.7 (RELATED ART)
FIG. 7 is a perspective view of main components of the diaphragm used for the known electricity-to-sound transducer.
Figure 8:
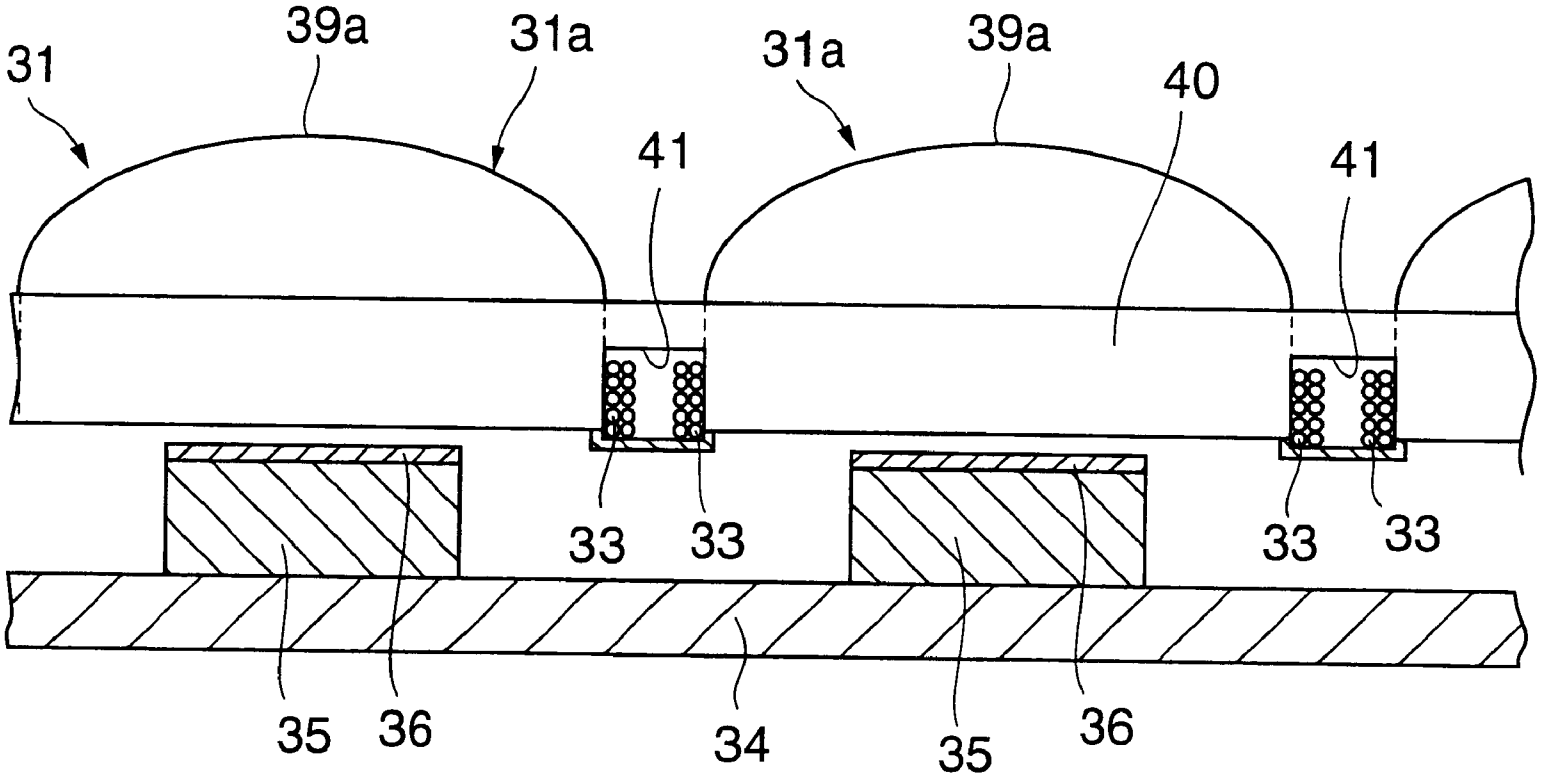
FIG.8 (RELATED ART)
FIG. 8 is a partial sectional view of the diaphragm used for the known electricity-to-sound transducer.
Figure 9:
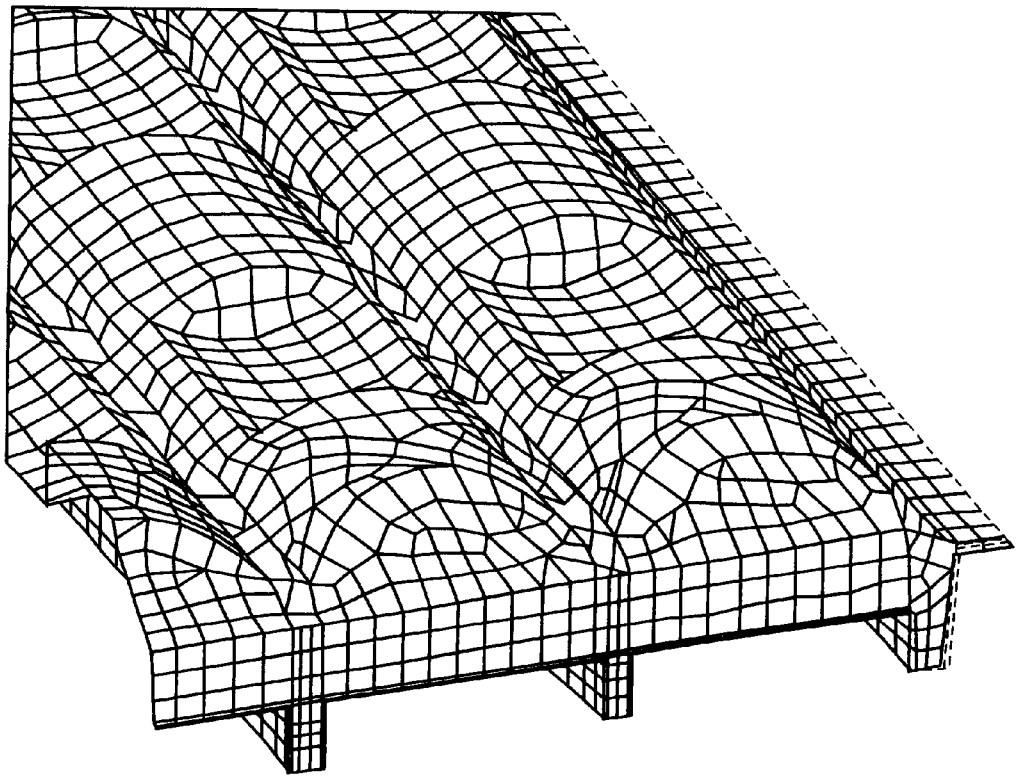
FIG. 9 illustrates vibration that occurs on the diaphragm used for the known electricity-to-sound transducer in a free-vibration mode.
Figure 10:
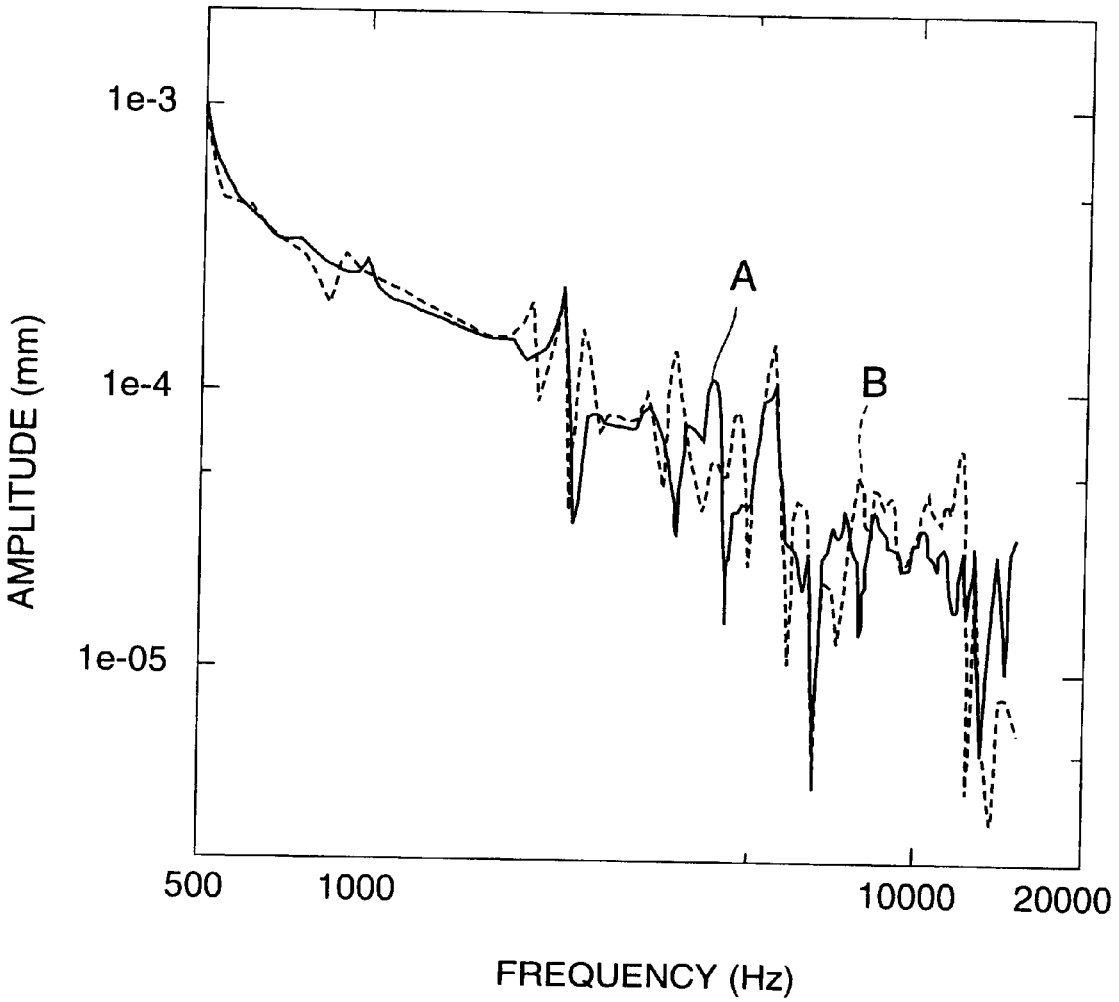
FIG. 10 is a graph indicating a result of numerical analysis on the frequency response characteristics of vibration amplitude around the center section of the diaphragm used for the known electricity-to-sound transducer.
Figure 11:
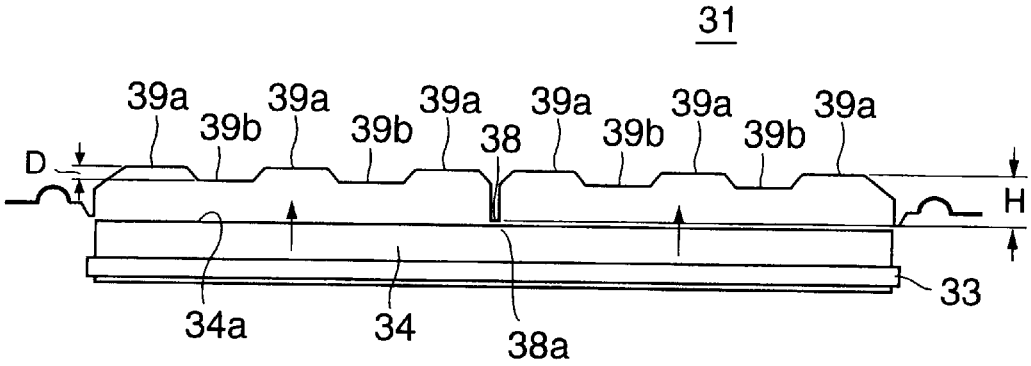
FIG. 11 is a sectional view illustrating the relationship between the diaphragm and the voice coil bobbin used for the known electricity-to-sound transducer.
Figure 12:
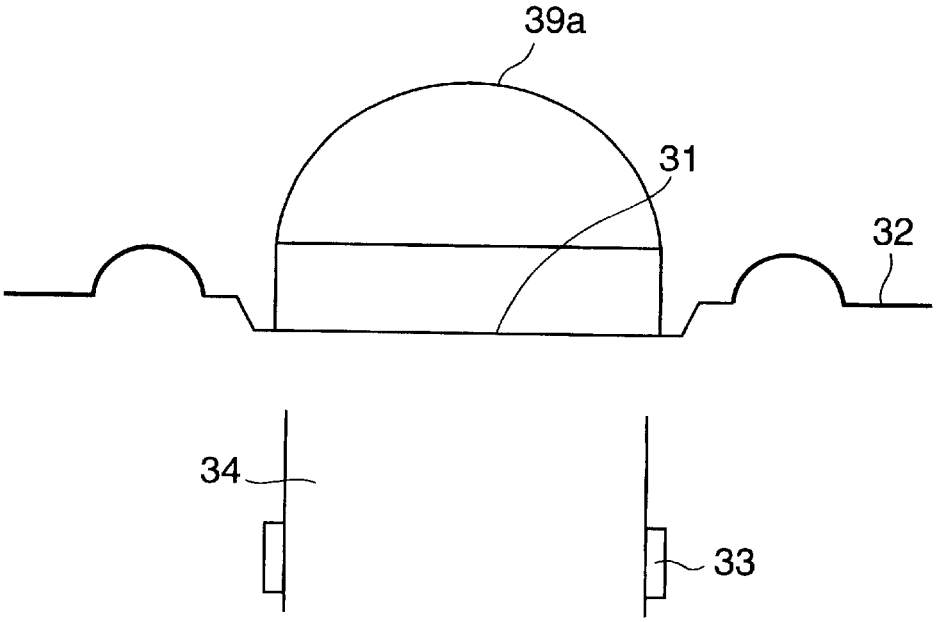
FIG. 12 is a transverse cross sectional view illustrating the relationship between the diaphragm and the voice coil bobbin used for the known electricity-to-sound transducer, at the center slot section.

This deformation also causes the similar deformation to the voice-coil bobbin 24. In detail, the deformed diaphragm 21 forces the center section of the bobbin 24 in the longitudinal direction to touch the pole piece 28, thus producing abnormal sound. It also causes distortion (such as secondary and tertiary harmonic distortion), as shown in FIG. 4, in the acoustic-pressure frequency characteristics in the middle and high tone ranges. The deformation of the bobbin 24 occurring at the center section in the direction perpendicular to the longitudinal direction reaches 0.5 mm at 2V input.

Preferred embodiments according to the present invention will be disclosed with reference to the attached drawings.

Figure 13:
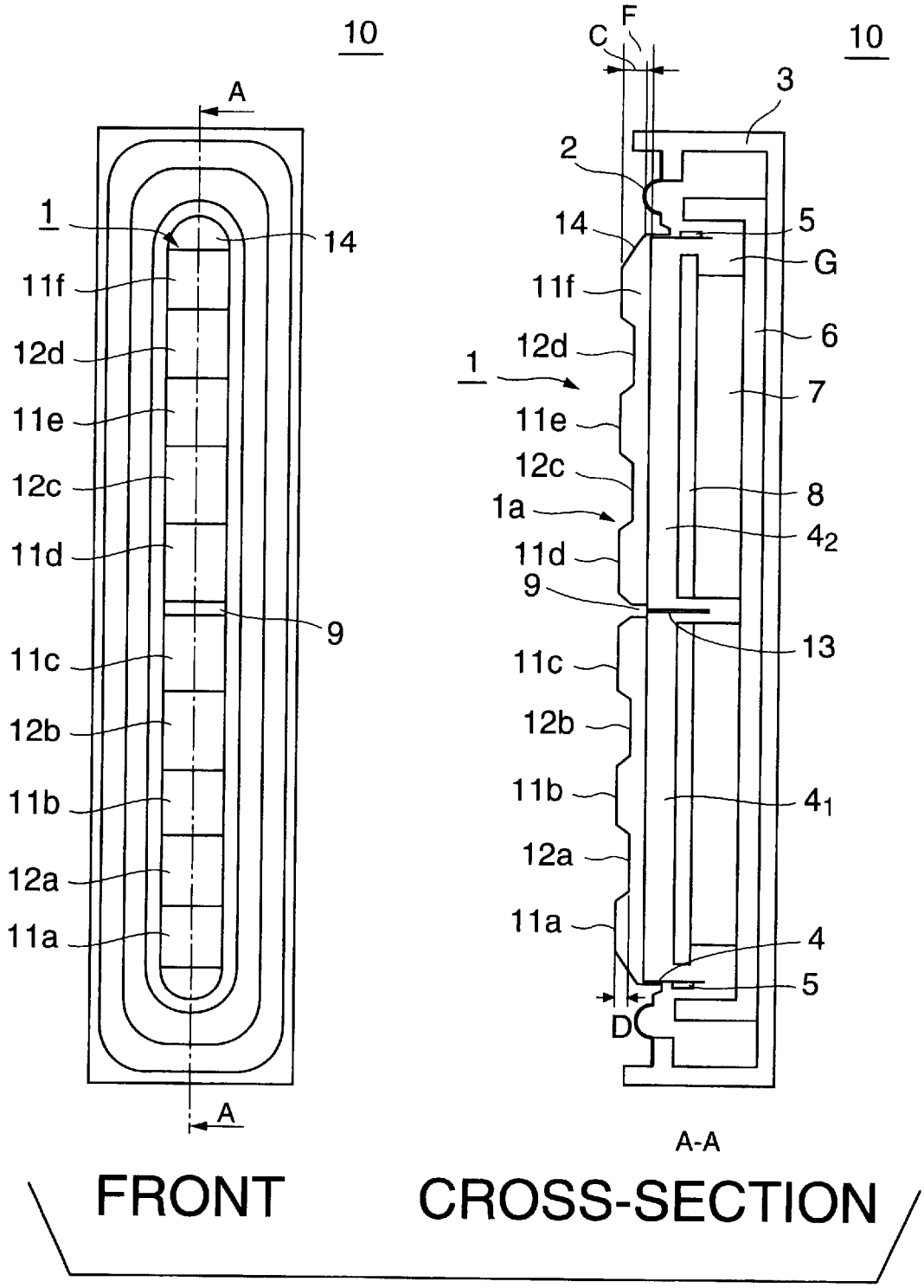
FIG. 13 shows an embodiment of an electricity-to-sound transducer according to the present invention.
Figure 14:
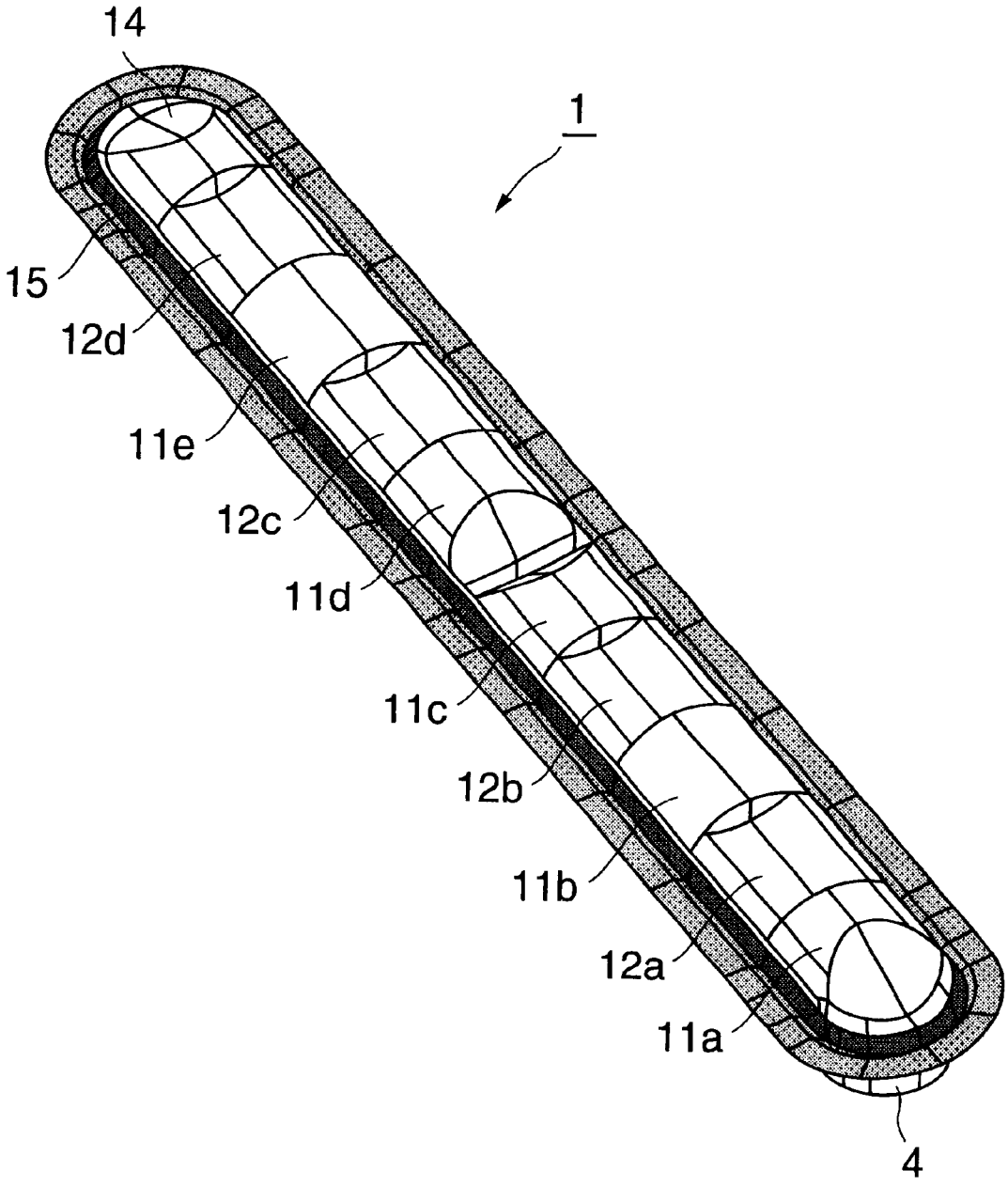
FIG. 14 is a perspective view of a diaphragm as one of the main components of the electricity-to-sound transducer shown in FIG. 13.

FIG. 13 shows a front view (FRONT) and a cross-sectional view (CROSS-SECTION) taken on line A—A of a preferred embodiment of an electricity-to-sound transducer 10 according to the present invention.

A diaphragm 1 has an asymmetric shape which is flat when viewed from the direction of vibration, with major and minor axes, having continuous curvatures of concavity and convexity in the direction of sound irradiation. An edge 2 is joined to the diaphragm 1 at periphery and held by a frame 3.

Figure 15:
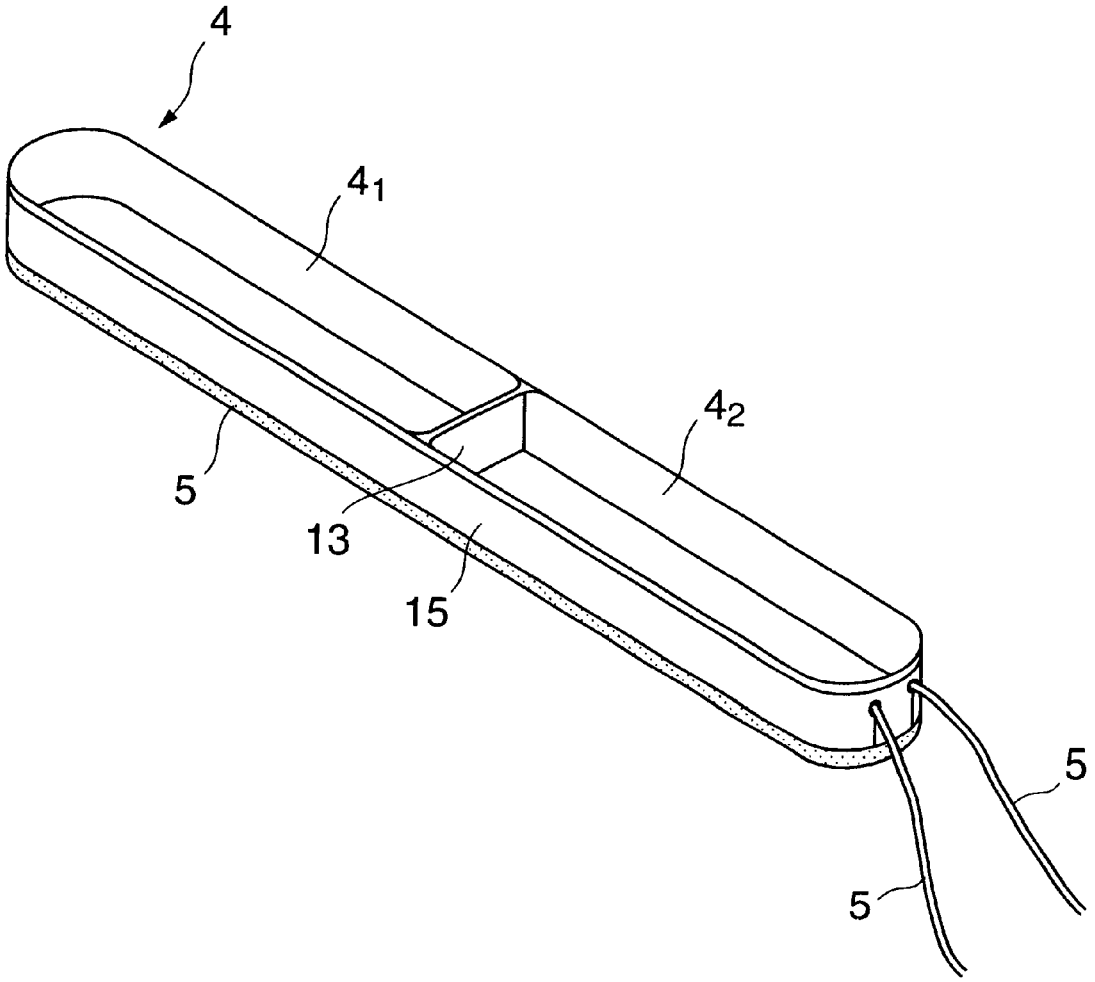
FIG. 15 is a perspective view of a voice coil bobbin around which a voice coil is wound, as another of the main components of the electricity-to-sound transducer shown in FIG. 13.
Figure 16:
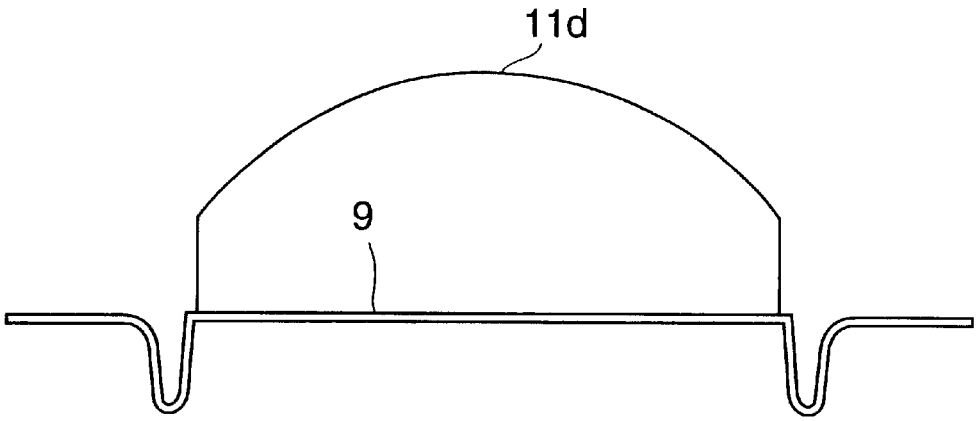
FIG. 16 is a transverse cross sectional view of the diaphragm of the electricity-to-sound transducer shown in FIG. 13, at the center section in the longitudinal direction.
Figure 17:
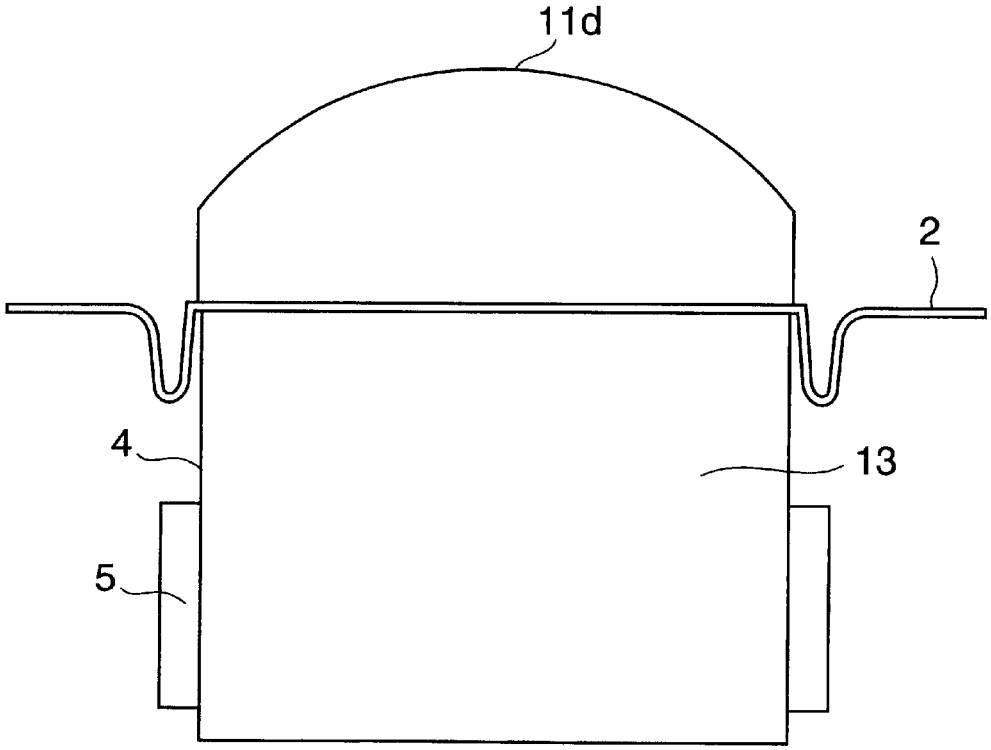
FIG. 17 is a transverse cross sectional view illustrating engagement of the voice coil bobbin and the diaphragm of the electricity-to-sound transducer shown in FIG. 13, at the center section in the longitudinal direction.

A track-type voice-coil bobbin 4 shown in FIG. 15 is attached to the diaphragm 1 at the rear surface of the bobbin, for example, by an adhesive, with a voice coil 5 wound around the lower edges of the bobbin outer periphery. The voice-coil bobbin 4 is hanging in a magnetic gap G of a magnetic circuit which will be described later, for generating a driving power from voice signal currents and fluxes.

The frame 3 is like a box that is bending at the side-face sections toward the direction of the edge 2. The magnetic circuit described above is mounted on the inner bottom of the frame 3. An iron yoke 6, a magnet 7 and a pole piece 8 constitute the magnetic circuit, which are fixed at respective positions by a tool (not shown). In particular, the magnet 7 and the pole piece 8 are fixed at the positions that correspond to a main vibrating section of the diaphragm 1.

The diaphragm 1 is described in detail. It has an asymmetric shape which is flat when viewed from the direction of vibration, with major and minor axes, having continuous curvatures of concavity and convexity in the direction of sound irradiation, as mentioned above. Portions 11*a*, 11*b*, 11*c*, 11*d*, 11*e* and 11*f* are formed in convexity whereas portions 12*a*, 12*b*, 12*c* and 12*d* in concavity. These convex and the concave portions are provided alternately to form continuous curvatures. The concave portions have almost the same depth D except the center section. The diaphragm 1 is made of a polyimide (PI) film that is heat-resistant against the voice coil 5 and excellent in mechanical properties.

The diaphragm 1 is also provided with a slot 9 formed almost at the center in the direction perpendicular to the longitudinal direction of the diaphragm. The slot 9 has a depth F deeper than the depth D of the concave portions and having almost the same height as a height C of a shoulder 14 of the diaphragm 1. The shoulder is formed as a rising portion of the convex portion. The convex portions 11*a* to 11*f*, the concave portions 12*a* to 12*f* and the slot 9 are formed with a PI film as being integral with each other.

Disclosed next in detail is the voice coil bobbin 4 fixed on the lower edges of the diaphragm 1 around the periphery.

As shown in FIG. 15, the voice coil bobbin 4 has an asymmetric shape which is flat with major and minor axes when viewed from the direction of vibration for the diaphragm 1, portions of the bobbin being formed in straight and parallel to each other in the direction in relation to the major axis of the diaphragm 1.

Figure 18:
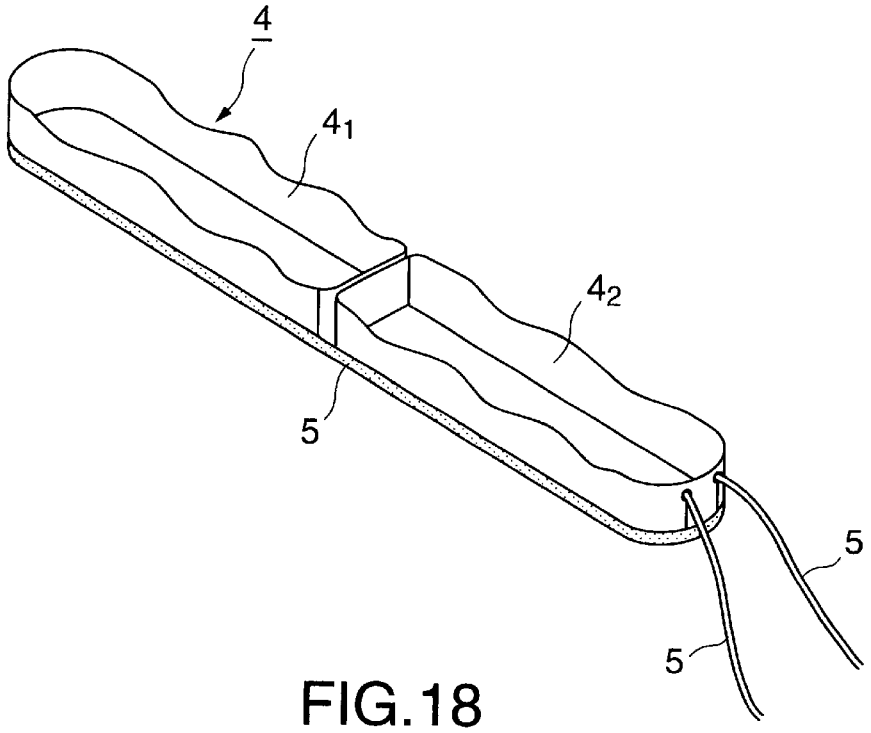
FIG. 18 is a perspective view showing deformation occurred to the voice coil bobbin.

Moreover, the voice coil bobbin 4 has a voice coil forming portion, around which the voice coil is wound, split into two in the direction of the major axis of the diaphragm 1. The split portions are joined to each other so that they are parallel to each other in the direction of the minor axis of the diaphragm 1, thus forming a reinforcing beam 13. A band 15 made of a kraft paper is wound around the outer periphery of the bobbin 4 as a reinforcing paper. This reinforcing paper is one of the important parts of the diaphragm 1. Because the bobbin 4 will be deformed as illustrated in FIG. 18, without the band 15, thus being of no use anymore.

Figure 19:
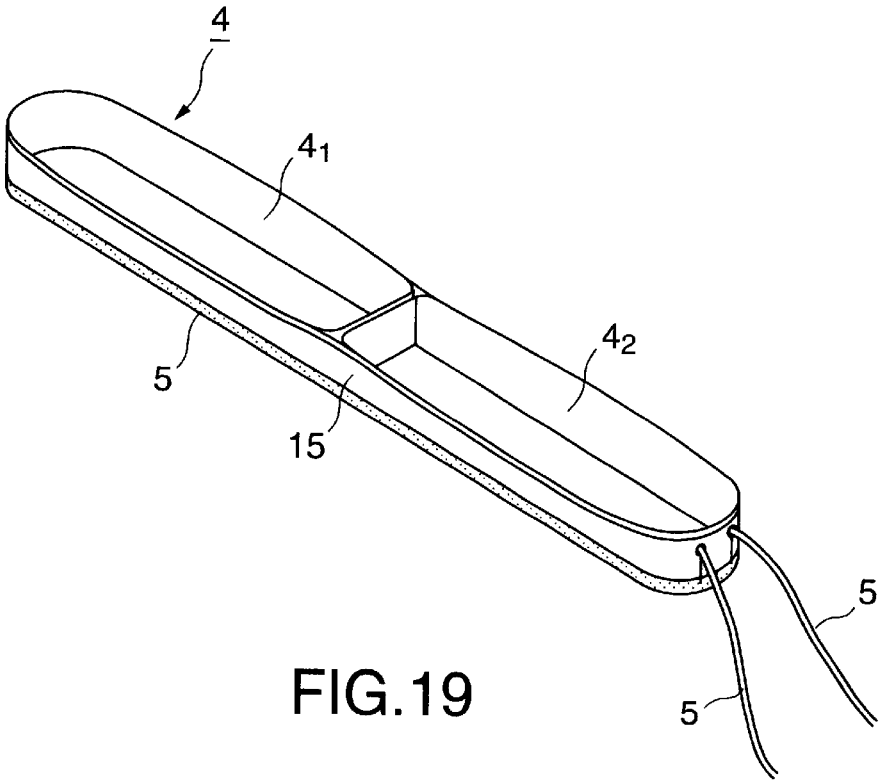
FIG. 19 is another perspective view showing deformation occurred to the voice coil bobbin.

The voice coil forming portion should be formed with care when it is formed with a kraft paper. In detail, a kraft paper used as a band bonded to a remaining part (with no coil wound) of the voice coil forming portion after coil is wound and another kraft paper used for the forming portion must be provided so that pulp resins of the papers are arranged as they cross each other at 90 degrees. Otherwise, the voice coil bobbin 4 will be deformed as illustrated in FIG. 19, thus being of no use anymore. This could happen due to moisture content for the kraft papers if they are not provided as such.

The voice coil bobbin 4 formed as above has the depth F for the slot 9 deeper than the depth D of the concave portions and having almost the same length as the height C of the shoulder 14 of the diaphragm 1, as disclosed above. Therefore, the bobbin can be inserted from the bottom of the diaphragm 1 and directly fixed under the slot 9 at the prescribed position as shown in FIGS. 13 (CROSS-SECTIN), 16 and 17 with no problems.

Disclosed next is an operation of the electricity-to-sound transducer 10 having the structure described above.

A magnetic field is generated around the voice coil 4 by magnets 7 to cause a drive current flowing the coil 5 for generating an electromagnetic force. The main vibrating portions 1*a* are vibrated by the electromagnetic force, and thus the diaphragm 1 is vibrated. During this vibration, however, distributed vibration is prevented from occurrence at the center section of the diaphragm 1 in the longitudinal direction because the slot 9 on the center section are supported by the reinforcing beam 13 so that the diaphragm 1 will not be fallen inwardly at the center section in the longitudinal direction.

The upper surface of the diaphragm 1 is formed such that the semi-circular cylinder portions 11*a*, 11*b*, 11*c*, 11*d*, 11*e* and 11*f* curved outwardly in the direction of sound radiation and the semi-circular cylinder portions 12*a*, 12*b*, 12*c* and 12*d* curved inwardly are provided alternately in the longitudinal direction, thus large and small vibration components discussed already are complimentarily prevented from occurrence.

Figure 20:
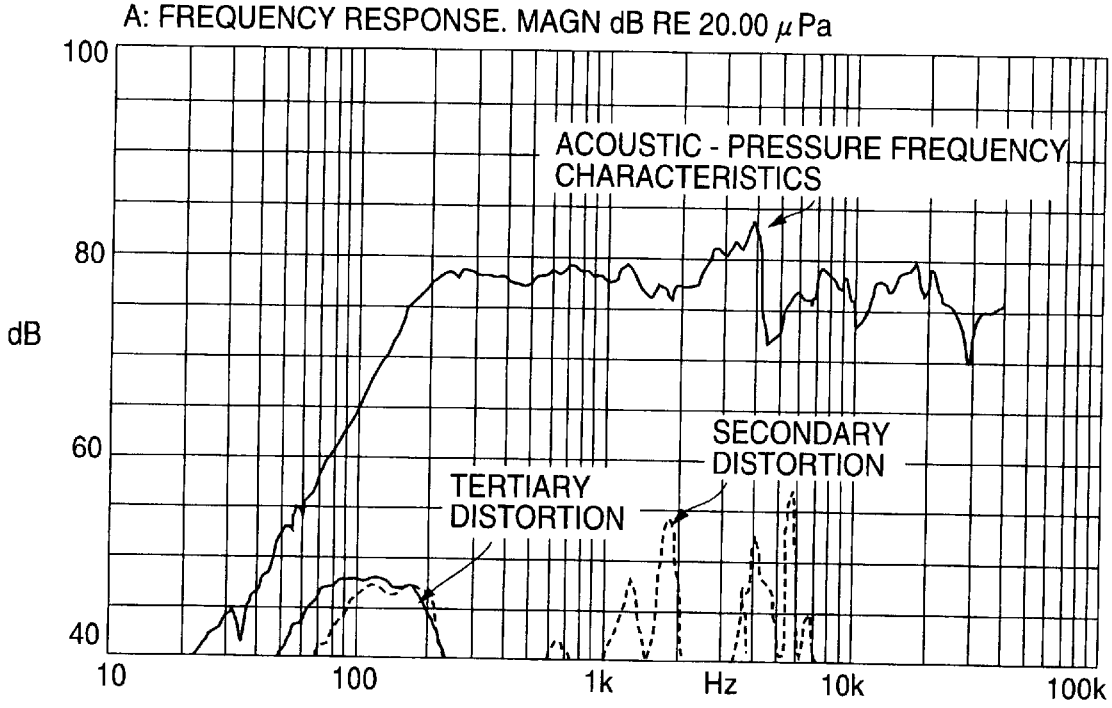
FIG. 20 is a graph indicating frequency characteristics of the electricity-to-sound transducer shown in FIG. 13.

FIG. 20 shows the acoustic-pressure frequency characteristics and the harmonic distortion characteristics of the electricity-to-sound transducer according to the present invention.

This figure indicates a drastic decrease in secondary and tertiary harmonic distortion at frequencies from 500 Hz to 1 KHz for the transducer 10, which occur for the known electricity-to-sound transducer due to vibration at the center concave section of the diaphragm as already discussed. The deformation of the voice coil bobbin 4 occurring at the center section in the direction perpendicular to the longitudinal direction decreased to 0.06 mm in this embodiment from 0.5 mm for the known transducer at 2V input.

Disclosed next is another preferred embodiment of an electricity-to-sound transducer 50 according to the present invention. Elements in this embodiment that are the same as or analogous to the elements in the former embodiment are referenced by the same numbers.

Figure 21:
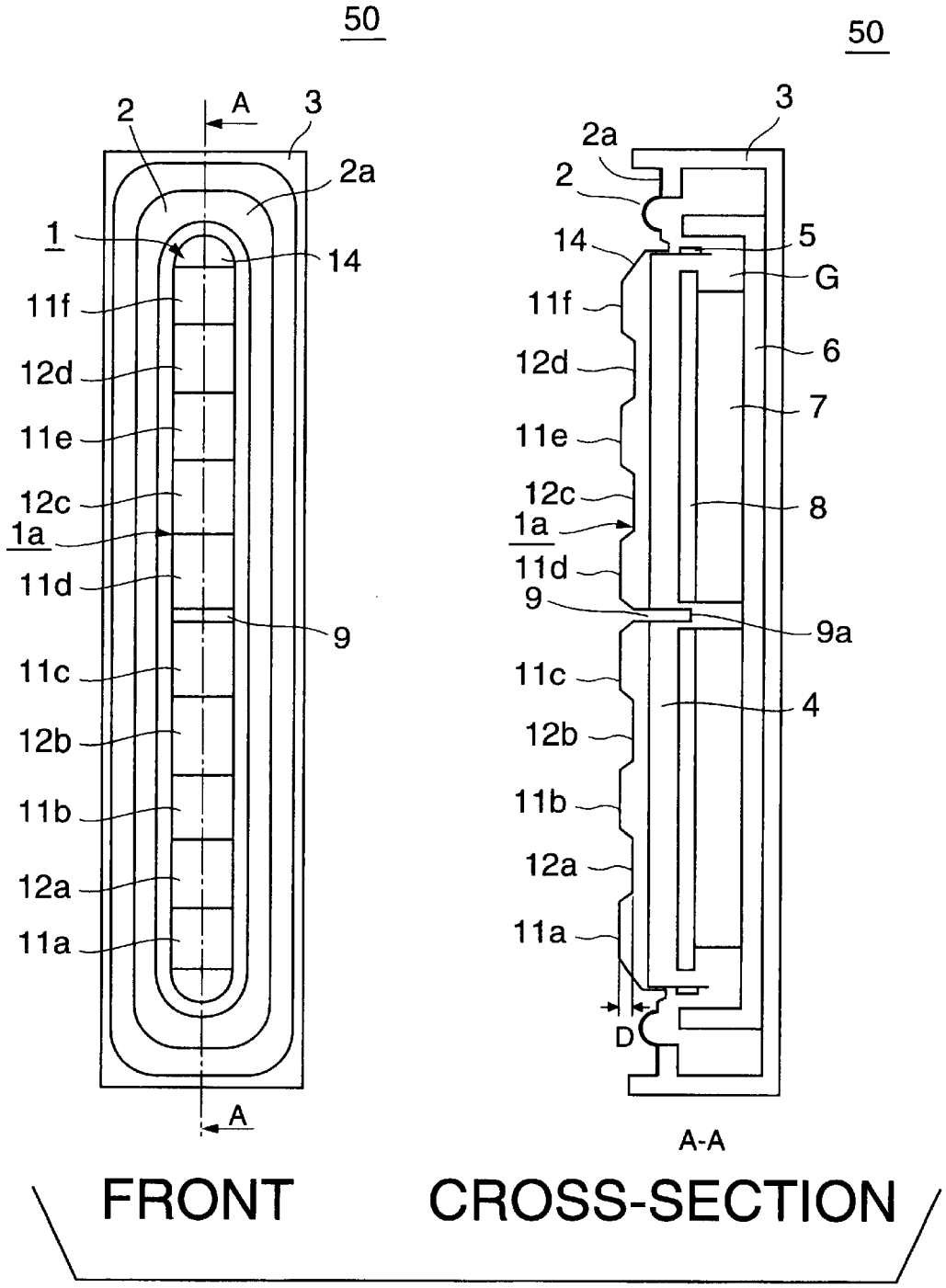
FIG. 21 shows another embodiment of an electricity-to-sound transducer according to the present invention.
Figure 22:
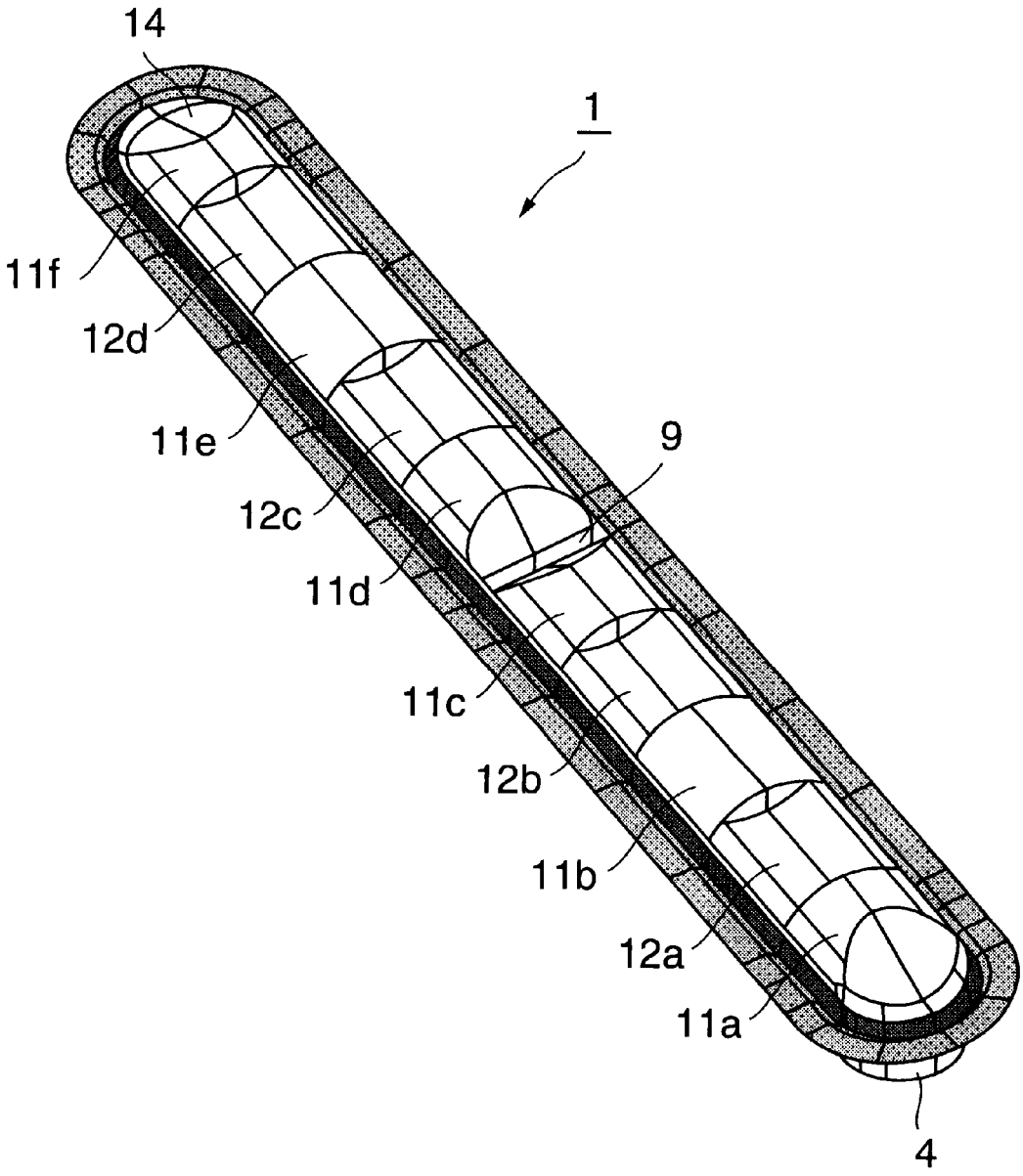
FIG. 22 is a perspective view of a diaphragm as one of the main components of the electricity-to-sound transducer shown in FIG. 21.

As shown in FIGS. 21 and 22, a diaphragm 1 has an asymmetric shape which is flat when viewed from the direction of vibration, with major and minor axes, having continuous curvatures of concavity and convexity in the direction of sound irradiation. An edge 2 is joined to the diaphragm 1 at periphery and held by a frame 3.

Figure 23:
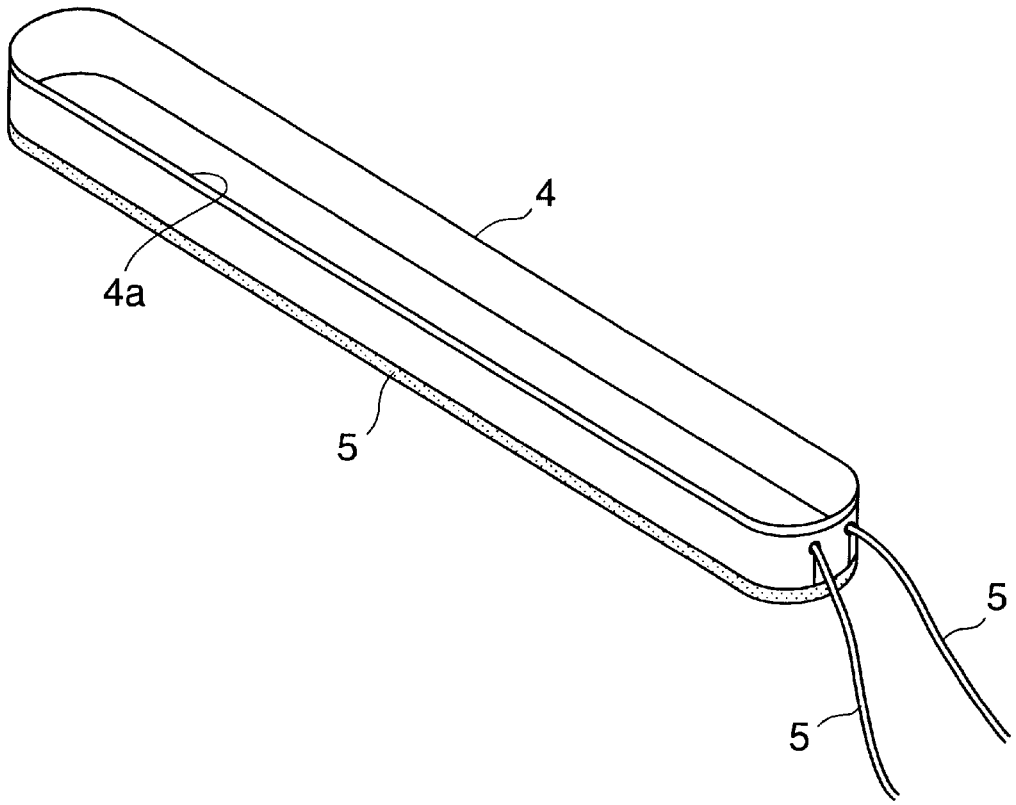
FIG. 23 is a perspective view of a voice coil bobbin around which a voice coil is wound, as another of the main components of the electricity-to-sound transducer shown in FIG. 21.

A track-type voice coil bobbin 4 shown in FIG. 23 is attached to the diaphragm 1 at the rear surface of the bobbin for example, by an adhesive, with a voice coil 5 wound around the lower edges of the bobbin outer periphery. The voice coil bobbin 4 is hanging in a magnetic gap G of a magnetic circuit which will be described later, for generating a driving power from voice signal currents and fluxes.

The frame 3 is like a box that is bending at the side-face sections toward the direction of the edge 2. The magnetic circuit described above is mounted on the inner bottom of the frame 3. An iron yoke 6, a magnet 7 and a pole piece 8 constitute the magnetic circuit, which are fixed at respective positions by a tool (not shown). In particular, the magnet 7 and the pole piece 8 are fixed at the positions that correspond to a main vibrating section of the diaphragm 1.

The diaphragm 1 is described in detail. It has an asymmetric shape which is flat when viewed from the direction of vibration, with major and minor axes, having continuous curvatures of concavity and convexity in the direction of sound irradiation, as mentioned above. Portions 11*a*, 11*b*, 11*c*, 11*d*, 11*e* and 11*f* are formed in convexity whereas portions 12*a*, 12*b*, 12*c* and 12*d* in concavity. These convex and the concave portions are provided alternately to form continuous curvatures. The concave portions have almost the same depth D except the center section. The diaphragm 1 is made of a polyimide (PI) film that is heat-resistant against the voice coil 5 and excellent in mechanical properties.

Figure 24:
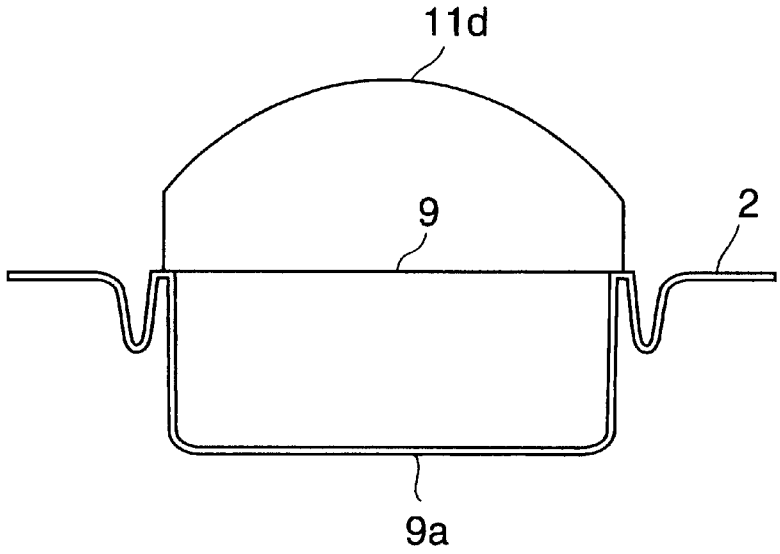
FIG. 24 is a transverse cross sectional view of the diaphragm of the electricity-to-sound transducer shown in FIG. 21, at the center section in the longitudinal direction.

The diaphragm 1 is also provided with a slot 9 formed almost at the center in the direction perpendicular to the longitudinal direction of the diaphragm. As shown in FIG. 24, the slot 9 greatly protrudes to form a protrusion in the direction of the rear surface of the diaphragm. The protrusion has walls at both ends in the direction of the major axis and also walls at both ends in the direction of the minor axis. The outer size of the protrusion in the minor axis direction is made a little bit smaller than the inner size (in the minor axis direction) of the voice coil bobbin 4 at almost the center in the major axis. The protrusion is inserted into the bobbin 4 as disclosed later. The convex portions 11*a* to 11*f*, the concave portions 12*a* to 12*f* and the slot 9 are formed with a PI film as being integral with each other.

Figure 25:
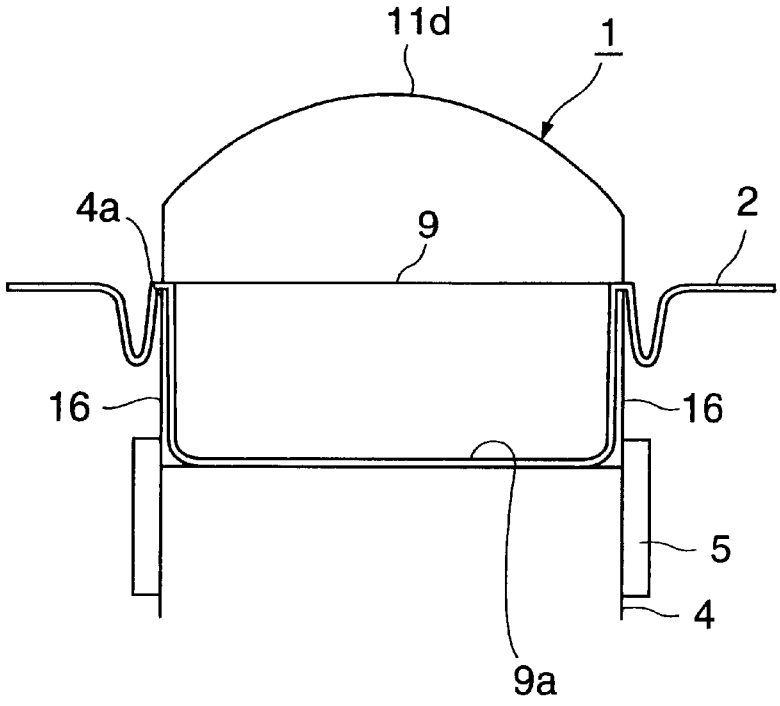
FIG. 25 is a transverse cross sectional view illustrating engagement of the voice coil bobbin and the diaphragm of the electricity-to-sound transducer shown in FIG. 21, at the center section in the longitudinal direction.

As shown in FIG. 25, the protrusion is inserted into the voice coil bobbin 4 when the bobbin is attached to the rear surface of the diaphragm 1. The lower edge of the protrusion (a lower edge 9*a* of the slot 9) reaches the middle section of the bobbin 4 in the depth direction. The both ends of the protrusion in the minor axis direction is bonded to the inner wall of the bobbin 4 by an adhesive 16.

Such positional relationship with the voice coil bobbin 4 is provided by as simple operation using for instance an adhesive because the size of the slot 9 is accurately determined by using a metal mold for precise location of the slot.

The voice coil bobbin 4 has an asymmetric shape which is flat when viewed from the direction of vibration for the diaphragm 1, with major and minor axes, portions of the bobbin being formed in straight parallel to each other in the direction in relation to the major axis of the diaphragm 1.

Although not shown, a band made of a kraft paper is wound around the outer periphery of the voice coil bobbin 4 as a reinforcing paper. This reinforcing paper is one of the important parts of the diaphragm 1. Because the bobbin 4 will be deformed like shown in FIG. 18, without such a band, thus being of no use anymore. Kraft paper should be used with care the same as discussed in the former embodiment.

A magnetic field is generated around the voice coil 4 by magnets 7 to cause a drive current flowing the coil 5 for generating an electromagnetic force. The main vibrating portions 1*a* are vibrated by the electromagnetic force, and thus the diaphragm 1 is vibrated. During this vibration, however, distributed vibration is prevented from occurrence at the center section of the diaphragm 1 in the longitudinal direction. This is because both ends of the protrusion in the minor axis is bonded to the inner wall of the voice coil bobbin 4.

The upper surface of the diaphragm 1 is formed such that the semi-circular cylinder portions 11*a*, 11*b*, 11*c*, 11*d*, 11*e* and 11*f* curved outwardly in the direction of sound radiation and the semi-circular cylinder portions 12*a*, 12*b*, 12*c* and 12*d* curved inwardly are provided alternately in the longitudinal direction, thus large and small vibration components discussed already are complimentarily prevented from occurrence.

Figure 26:
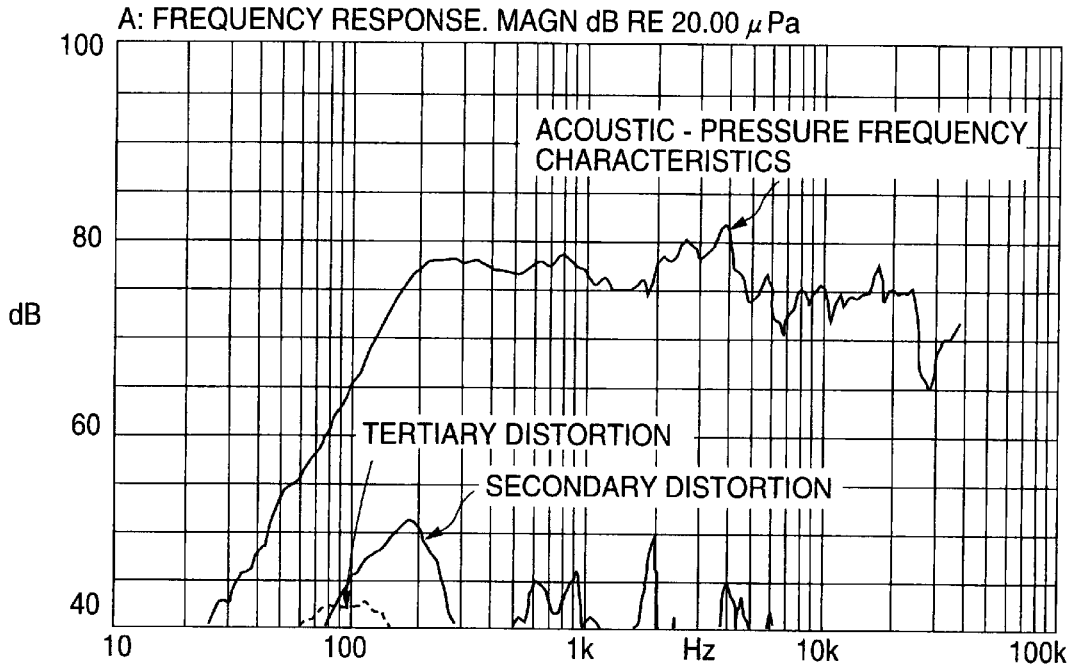
FIG. 26 is a graph indicating frequency characteristics of the electricity-to-sound transducer shown in FIG. 21.

FIG. 26 shows the acoustic-pressure frequency characteristics and the harmonic distortion characteristics of the electricity-to-sound transducer 50 in this embodiment according to the present invention in which the protrusion and the voice coil bobbin 4 are bonded to each other by the adhesive 16.

Figure 27:
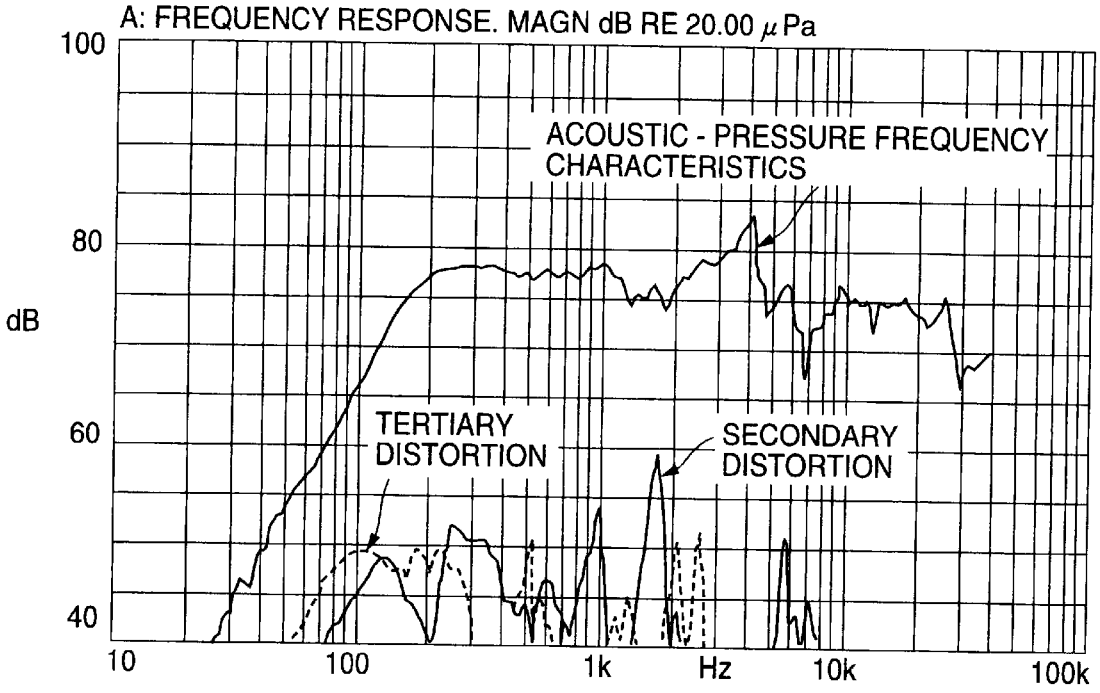
FIG. 27 is a graph indicating frequency characteristics of a sample electricity-to-sound transducer with no adhesive used.

For comparison, FIG. 27 shows the acoustic-pressure frequency characteristics and the harmonic distortion characteristics of a sample electricity-to-sound transducer with no adhesive between the protrusion and the voice coil 4.

FIGS. 26 and 27 indicate a drastic decrease in secondary and tertiary harmonic distortion at frequencies from 500 Hz to 1 KHz for the transducer 50, which occur for the sample electricity-to-sound transducer due to vibration at the center concave section of the diaphragm as already discussed.

The deformation of the voice coil bobbin 4 occurring at the center section in the direction perpendicular to the longitudinal direction, or an amplitude of vibration, occurring at almost the center of the diaphragm 1, perpendicular to the longitudinal direction of the diaphragm decreases to 0.06 mm in this embodiment from 0.5 mm for the known transducer at 2V input.

As disclosed above, the present invention provides an electricity-to-sound transducer having a diaphragm having an asymmetric shape which is flat when viewed from a direction of vibration, with major and minor axes, having continuous curvatures of concavity and convexity in a direction of sound irradiation, provided with a slot formed almost at a center of the diaphragm in a direction perpendicular to a longitudinal direction of the diaphragm. An edge portion is formed as surrounding an outer periphery of the diaphragm, an inner section of the edge portion being connected to the outer periphery, the edge portion sustaining the diaphragm so that it can vibrate. A voice coil bobbin has a winding portion around which a voice coil is wound split into two portions in the longitudinal direction of the diaphragm. The voice coil is applied flux by a magnetic circuit for vibration. The outer periphery of the edge portion and the magnetic circuit are sustained by a frame.

The bobbin is attached to a rear surface of the diaphragm while the two portions are joined to each other, the joined portions forming a reinforcing beam that reaches a rear surface of a bottom of the slot of the diaphragm, thus achieving acoustic reproduction with no harmonic distortion which may otherwise occur due to vibration at the center concavity.

Moreover, the present invention provides an electricity-to-sound transducer having a diaphragm having an asymmetric shape which is flat when viewed from a direction of vibration, with major and minor axes, having continuous curvatures of concavity and convexity in a direction of sound irradiation, provided with a slot formed almost at a center of the diaphragm in a direction perpendicular to a longitudinal direction of the diaphragm, the slot having walls on a bottom of slot, on both ends of the slot in a direction of the major axis and on both ends of the slot in a direction of the minor axis, the slot protruding in a direction of a rear surface of the diaphragm to form a protrusion. An edge portion is formed as surrounding an outer periphery of the diaphragm, an inner section of the edge portion being connected to the outer periphery, the edge portion sustaining the diaphragm so that it can vibrate. A voice coil is wound around the voice coil bobbin. The voice coil is applied flux by a magnetic circuit for vibration. The outer periphery of the edge portion and the magnetic circuit are sustained by a frame.

The voice coil bobbin is attached to the rear surface of the diaphragm, an inner size of the bobbin almost at the center in the longitudinal direction being larger than an outer size of the protrusion in the direction of the minor axis, the protrusion being inserted into the bobbin, a gap between an inner wall of the bobbin and the protrusion being filled with an adhesive so that the protrusion and the bobbin are bonded to each other, thus achieving acoustic reproduction with no harmonic distortion which may otherwise occur due vibration at the center concavity.

What is claimed is:

1. An electricity-to-sound transducer comprising:

a diaphragm having an asymmetric shape which is flat when viewed from a direction of vibration, with major and minor axes, having continuous curvatures of concavity and convexity in a direction of sound irradiation, provided with a slot formed almost at a center of the diaphragm in a direction perpendicular to a longitudinal direction of the diaphragm;

an edge portion formed as surrounding an outer periphery of the diaphragm, an inner section of the edge portion being connected to the outer periphery, the edge portion sustaining the diaphragm for vibration;

a voice coil bobbin having a winding portion around which a voice coil is wound split into two portions in the longitudinal direction of the diaphragm, the bobbin being attached to a rear surface of the diaphragm while the two portions are joined to each other, the joined portions forming a reinforcing beam that reaches a rear surface of a bottom of the slot of the diaphragm;

a magnetic circuit for applying flux to the voice coil for vibration; and a frame for sustaining the outer periphery of the edge portion and the magnetic circuit.

2. The electricity-to-sound transducer according to claim 1, wherein the winding portion of the voice coil bobbin is formed with a kraft paper, the kraft paper and a band of a kraft paper bonded to remaining portions of the voice coil bobbin except the winding portion being provided so that pulp resins of the kraft papers are arranged as crossing each other at 90 degrees.

3. The electricity-to-sound transducer according to claim 1, wherein the slot of the diaphragm has a depth deeper than a depth of the concavity and almost the same height as a height of a rising portion of the convexity.

4. An electricity-to-sound transducer comprising:

a diaphragm having an asymmetric shape which is flat when viewed from a direction of vibration, with major and minor axes, having continuous curvatures of concavity and convexity in a direction of sound irradiation, provided with a slot formed almost at a center of the diaphragm in a direction perpendicular to a longitudinal direction of the diaphragm, the slot having walls on a bottom of slot, on both ends of the slot in a direction of the major axis and on both ends of the slot in a direction of the minor axis, the slot protruding in a direction of a rear surface of the diaphragm to form a protrusion;

an edge portion formed as surrounding an outer periphery of the diaphragm, an inner section of the edge portion being connected to the outer periphery, the edge portion sustaining the diaphragm for vibration;

a voice coil bobbin attached to the rear surface of the diaphragm, an inner size of the bobbin almost at the center in the longitudinal direction being larger than an outer size of the protrusion in the direction of the minor axis, the protrusion being inserted into the bobbin, a gap between an inner wall of the bobbin and the protrusion being filled with an adhesive so that the protrusion and the bobbin are bonded to each other;

a voice coil wound around the voice coil bobbin;

a magnetic circuit for applying flux to the voice coil for vibration; and a frame for sustaining the outer periphery of the edge portion and the magnetic circuit.

5. The electricity-to-sound transducer according to claim 4, wherein a winding portion of the voice coil bobbin around which the voice coil is formed with a kraft paper, the kraft paper and a band of a kraft paper bonded to remaining portions of the voice coil bobbin except the winding portion being provided so that pulp resins of the kraft papers are arranged as crossing each other at 90 degrees.

* * * * *